US009968192B2

(12) United States Patent
Albrecht et al.

(10) Patent No.: US 9,968,192 B2
(45) Date of Patent: May 15, 2018

(54) DEVICE FOR MOVING A MOVABLE FURNITURE PART, AND ITEM OF FURNITURE

(71) Applicant: Grass GmbH, Hoechst (AT)

(72) Inventors: Markus Albrecht, Lustenau (AT); Stefan Baur, Goetzis (AT)

(73) Assignee: Grass GmbH, Hoechst (AT)

( * ) Notice: Subject to any disclaimer, the term of this patent is extended or adjusted under 35 U.S.C. 154(b) by 0 days. days.

(21) Appl. No.: 15/239,025

(22) Filed: Aug. 17, 2016

(65) Prior Publication Data

US 2017/0049234 A1 Feb. 23, 2017

(30) Foreign Application Priority Data

Aug. 21, 2015 (DE) ..... 20 2015 104 439 U

(51) Int. Cl.
*A47B 88/04* (2006.01)
*E05C 19/02* (2006.01)
(Continued)

(52) U.S. Cl.
CPC ..... *A47B 88/463* (2017.01); *A47B 88/0477* (2013.01); *E05C 19/022* (2013.01);
(Continued)

(58) Field of Classification Search
CPC . A47B 88/463; A47B 88/0477; A47B 88/467; A47B 88/047; A47B 88/47;
(Continued)

(56) References Cited

U.S. PATENT DOCUMENTS 3,323,853 A * 6/1967 Stark ..... A47B 88/487 312/110
4,591,214 A * 5/1986 Reuter ..... E05D 15/582 312/110
(Continued)

FOREIGN PATENT DOCUMENTS

AT 514865 A1 * 4/2015 ..... A47B 88/0481
DE 20 2013 005 797 U1 9/2014
(Continued)

OTHER PUBLICATIONS

German Search Report (Application No. 20 2015 104 439.9) dated Jun. 7, 2016.
(Continued)

*Primary Examiner* — Andrew M Roersma
(74) *Attorney, Agent, or Firm* — Burr & Brown, PLLC

(57) ABSTRACT

A device for moving a movable furniture part, including a force accumulator such that by way of the fitted device the furniture part under action of the force accumulator is capable of being put in the opening direction of the furniture part, wherein in a tensioned position of the force accumulator the force accumulator is charged for the opening movement of the furniture part. The device has a locking assembly having a displaceable locking member for locking the tensioned position of the force accumulator, wherein the locking member in the tensioned position assumes a locking position which is unlockable. The locking member in the case of an unlocking procedure is movable from the locking position in a releasing direction, wherein a transmission installation by way of which a movement of the locking member is transmittable to a functional unit which is spaced apart from the locking member is provided.

9 Claims, 13 Drawing Sheets

(51) Int. Cl.

| | |
|---|---|
| ***E05F 1/16*** | (2006.01) |
| ***E05F 15/00*** | (2015.01) |
| ***E05B 65/46*** | (2017.01) |
| ***A47B 88/463*** | (2017.01) |

(52) U.S. Cl.
CPC ..... *E05F 1/16* (2013.01); *E05F 15/00* (2013.01); *A47B 2210/0083* (2013.01); *E05B 65/46* (2013.01); *E05Y 2201/22* (2013.01); *E05Y 2201/244* (2013.01); *E05Y 2201/426* (2013.01); *E05Y 2800/00* (2013.01); *E05Y 2900/20* (2013.01)

(58) Field of Classification Search
CPC ..... A47B 88/0481; A47B 2088/4675; A47B 2088/0474; A47B 2210/0083; A47B 88/453; A47B 88/46; A47B 88/40; A47B 88/44; A47B 88/45; A47B 2210/0016; A47B 2210/0064; A47B 2210/0078; E05Y 2201/426; E05Y 2201/618; E05Y 2201/624; E05Y 2201/626; E05Y 2900/20; E05Y 2201/244; E05C 19/022; E05F 1/16; E05B 65/46
See application file for complete search history.

(56) References Cited

U.S. PATENT DOCUMENTS

| | | | | |
|---|---|---|---|---|
| 8,152,250 | B2 * | 4/2012 | Aguilar Ante | A47B 88/40 312/331 |
| 8,534,781 | B2 * | 9/2013 | Netzer | A47B 88/0477 312/319.1 |
| 2014/0210329 | A1 * | 7/2014 | Brunnmayr | A47B 88/16 312/333 |
| 2016/0007748 | A1 | 1/2016 | Gasser et al. | |
| 2016/0135595 | A1 | 5/2016 | Erdel et al. | |
| 2016/0206093 | A1 * | 7/2016 | Brunnmayr | A47B 88/0481 |
| 2017/0049228 | A1 * | 2/2017 | Albrecht | A47B 88/0477 |
| 2017/0049229 | A1 * | 2/2017 | Albrecht | A47B 88/0477 |
| 2017/0049230 | A1 * | 2/2017 | Grabher | A47B 88/0477 |
| 2017/0049231 | A1 * | 2/2017 | Fellner | A47B 88/0477 |
| 2017/0049232 | A1 * | 2/2017 | Rihtarec | A47B 88/0477 |
| 2017/0049233 | A1 * | 2/2017 | Albrecht | A47B 88/0477 |
| 2017/0049234 | A1 * | 2/2017 | Albrecht | A47B 88/0477 |
| 2017/0049235 | A1 * | 2/2017 | Albrecht | E05F 1/16 |
| 2017/0049236 | A1 * | 2/2017 | Rihtarec | A47B 88/0477 |
| 2017/0051813 | A1 * | 2/2017 | Karu | E05F 1/16 |
| 2017/0095084 | A1 * | 4/2017 | Koenig | A47B 88/463 |

FOREIGN PATENT DOCUMENTS

| | | | | |
|---|---|---|---|---|
| DE | 20 2015 001 186 | U1 | 4/2015 | |
| WO | 2014/165878 | A1 | 10/2014 | |
| WO | WO 2015192153 | A1 * | 12/2015 | E05F 1/16 |
| WO | WO 2016164942 | A1 * | 10/2016 | A47B 88/463 |

OTHER PUBLICATIONS

Extended European Search Report (Application No. 16183505.3) dated Jan. 17, 2017.

* cited by examiner

DEVICE FOR MOVING A MOVABLE FURNITURE PART, AND ITEM OF FURNITURE

This application claims the benefit under 35 USC § 119(a)-(d) of German Application No. 20 2015 104 439.9 filed Aug. 21, 2015, the entirety of which is incorporated herein by reference.

FIELD OF THE INVENTION

The present invention relates to a device for moving a movable furniture part, and an item of furniture.

BACKGROUND OF THE INVENTION

In the case of furniture parts such as, for example, drawers, furniture doors, or furniture flaps which are movably received on a basic furniture structure of an item of furniture by guide means, devices for influencing the movement of the furniture part are employed. Devices of this type are formed by a unit which is attachable to the furniture part, to the basic furniture structure or the guide means at a suitable point, for example.

In particular, the guide means comprise a sliding guide such as a full pullout or a part pullout, or a pivoting guide such as a hinge.

In the case of modern and user-friendly items of furniture, devices for moving the furniture part are known, which may optionally be provided for providing an additional function, for example, in particular, in order to facilitate a user in opening the furniture part. The additional function is, in particular, adaptable to the type and size of the furniture part. The device for influencing the movement of the furniture part relates to systems for providing a force-assisted opening function for the furniture part, for example.

SUMMARY OF THE INVENTION

It is an object of the present invention to advantageously provide an additional function for movement of a furniture part by means of a sliding guide, such as a full pullout or part pullout, or of a pivoting guide, in particular, so as to provide an operationally reliable activation of a force-assisted opening movement of the furniture part on a first partial distance of the opening path, and to provide reliable transmission of the activation to respective units.

The present invention proceeds from a device for moving a movable furniture part in an opening direction of the furniture part in relation to a basic furniture structure of an item of furniture, wherein the movable furniture part by way of guide means is capable of being put in the opening direction and in a closing direction which is counter to the opening direction, wherein the device comprises a force accumulator such that by way of the fitted device the movable furniture part under action of the force accumulator is capable of being put in the opening direction of the movable furniture part, wherein in a tensioned position of the force accumulator the force accumulator is charged for the opening movement of the furniture part, and wherein the device has a locking assembly having a displaceable locking member for locking the tensioned position of the force accumulator, wherein the locking member in the tensioned position assumes a locking position which is unlockable.

Various movement functions relating to moving the furniture part on the item of furniture may advantageously be established by way of the device, in particular, for an opening movement of the furniture part from the retracted or inwardly pivoted position on the basic structure, in that a force accumulator causes or assists movement of the furniture part respectively. Utilization of the furniture part by a person is thus facilitated, or the effort in force required by the person for opening the resting furniture part is reduced, respectively, such that even comparatively heavy furniture parts are able to be comfortably moved. Moreover, even comparatively weak persons, such as the elderly and children, may utilize the furniture part, or move the latter from the closing position, respectively.

Preferably, the device is employable independently of a sliding guide or of a hinge, or is employable in addition thereto, respectively. Guiding of the movement per se is present so as to be additional to the device according to the present invention having the force accumulator. The device having the force-assisting function is readily retro-fittable and/or replaceable on the item of furniture or on the movable furniture part, respectively.

A first substantial aspect of the present invention lies in that the locking member in the case of an unlocking procedure is movable from the locking position in a releasing direction, wherein a transmission installation by way of which a movement of the locking member is transmittable to a functional unit which is spaced apart from the locking member is provided, and wherein the locking member and a movable drive portion of the device are mutually adapted in such a manner that the locking member upon departing from the locking position by the drive portion is movable onward in the releasing direction. The reliability of the transmission installation is thus improved in terms of effect on the functional unit. In particular, the locking member is not only moved out of the locking position thereof by way of the unlocking procedure, but the locking member is moved onward in the releasing direction. The onward movement is required in order for the transmission of movement to the functional unit to be performed with high reliability.

The drive portion of the device is movable in relation to the locking member, for example, is present on a movable lever which is pivotable, for example, and which is movable past the locking member. Additionally, the drive portion is preferably received so as to be movable in relation to the lever, for example, is pivotably received thereon.

To date, situations in which the movement of the locking member indeed has a functionally correct effect on those components which interact directly with the locking member but is not performed sufficiently far in order for the movement to be able to be transmitted to the functional unit to a degree which is sufficient for the functional unit arise again and again when the locking member is unlocked. In order for this factor to be able to be addressed a higher degree of the causal movement of the locking movement is required. The functional unit is thus effectively activatable.

It is ensured by the assembly according to the present invention that the locking member in the case of each unlocking procedure performs a movement which is at least necessary. Herein, the locking member is moved onward beyond the position per se for reliable unlocking on the device, purely for the purpose of reliably actuating the spaced apart functional unit.

The onward movement would not really be required in order for the tensioned position of the force accumulator of the device to be cancelled. However, the transmission installation may transmit the movement such that the activation of the functional unit is effective only in the case of an available movement path which is comparatively large.

To date, insufficient or non-performing instances of activating the functional unit by virtue of an insufficiently far movement of the locking member in the case of the locking member being unlocked are not precluded, which is disadvantageous.

The continuation of the movement of the locking member may be a further pivoting movement of the locking member when the latter is pivoted in the case of being unlocked, for example.

In particular, it is advantageous for a pivot angle of the locking member of, for example, 10 angular degrees to be performed in direct continuation of the actuation action per se of the drive portion, the pivot angle being directly caused by an actuation action, for example by a user depressing in the closing direction the furniture part which is held so as to be closed on the basic furniture structure. Without the assembly according to the present invention, having the drive unit, the locking member would not or only to a minor extent be pivoted onward; in particular, by way of a resetting force which typically acts on the locking member, the locking member would terminate the actuation pivoting movement thereof, and in the other pivoting direction return to the locking position. The force accumulator herein would indeed be unlocked, however, an element which is coupled to the locking member would not or only in rare cases carry out a sufficiently large movement. This is because in the transmission of the movement of the locking member by way of the transmission installation, due to the material properties of the materials, or due to the resilience thereof and/or to the component tolerances, a movement which is inferior to that of the locking member is received by the functional unit. This difference, or this deficient movement path, respectively, is compensated for by the effect of the drive portion. The drive portion enlarges the movement of the locking member to the extent that a sufficiently large movement path is always received by the functional unit and that, on account thereof, reliable operation of the functional unit or unlocking of a locking member of the functional unit, for example, respectively, arises at all times when the functional unit has tensioned state of a force accumulator that is unlockable by way of an unlocking member.

In relation to the movement path which has to be covered by the unlocking member in the case of the unlocking procedure until the locking position has been effectively exited, the drive portion continues the movement of the locking member by more than 20 percent, 40 percent, up to more than 50 percent, or up to approx. 100 percent.

A pivot angle of the locking member from a locking position up to exiting the locking position may be 10 angular degrees, for example, this being required for reliable unlocking. The drive portion continues the movement up to a total of 20 angular degrees, for example, in the releasing direction. The movement according to the 20 angular degrees is received by the transmission installation and is transmitted in the direction of the functional unit. The functional unit receives a movement which in most instances is not 20 angular degrees but less, but, in particular, is more than 10 angular degrees.

According to a further substantial aspect of the present invention, the locking member in the case of an unlocking procedure is movable from the locking position in a releasing direction, wherein a transmission installation by way of which a movement of the locking member is transmittable to a functional unit which is spaced apart from the locking member is provided, wherein for coupling the locking member in terms of motion to the function unit an elongate connection element of the transmission installation by way of a first end portion of the connection element is coupled in terms of motion to the locking member of the device, and by way of a second end portion of the connection element is coupled in terms of motion to an element of the functional unit. Enhanced reliability of the transmission of movement between the locking member and the element of the functional unit is thus enabled. The connection element is preferably designed so as to be rigid or torsionally stable, respectively.

Various units may be considered as functional units, for example, a further device on the furniture part, the device likewise serving for influencing the movement of the furniture part, for example, such as for the force-assisted opening movement of the furniture part, for example, or preferably being a twin device, respectively, which is constructed so as to have the identical action as the device or optionally being identical thereto.

Additionally or alternatively, the function unit may comprise a switch unit to which the movement of the locking member is transmittable by way of the connection element and which, in particular, is switchable in a synchronous manner with the movement of the locking member. A switched state of the switch unit which may assume a plurality of different switched states may thus be modified in the case of a transmission of movement. For example, the functional unit may comprise a force accumulator, a movement-damping unit, and/or a drive unit such as an electric motor or the like, each having an element by way of which the second end portion of the connection element is coupled. Preferably the drive unit is capable of being switched on or off by way of the movement of the locking member, or in the switched state is modifiable in terms of output.

For example, in the case of a drawer which by way of guide means, in particular, by way of two full pullouts is guided in each case laterally on the basic furniture structure, the transmission installation comprises a synchronization assembly. By way of the synchronization assembly, the unlocking movement of the locking member of the device that acts in the region of the first lateral full pullout is transmittable in a synchronized manner to a locking member of a twin device which is additionally present on the drawer. The twin device is effective on the furniture part in the region of the second full pullout, for example, in order to enable a force-assisted opening movement of the furniture part on the second full pullout. The drawer may thus be opened in a force-assisted manner on both sides.

Synchronized unlocking of the locking member is a fundamental precondition for the smooth and simultaneous action of the force assistance, this being implemented by way of the assembly according to the present invention, having the transmission installation. If and when a user actuates unlocking of the locking member on one side of the drawer, by virtue of constructive and spatial reasons it is not precluded that the locking member of the twin device is not unlocked without a transmission unit and that the force accumulator of the twin device thus cannot become effective. This is the focus of the present invention, according to which by virtue of the transmission unit both devices, or the locking member of the twin device and the locking member of the first device, respectively, may, in particular, be unlocked collectively and simultaneously. The two ejector units are unlocked in a synchronous manner by way of the synchronizing transmission unit which acts and is referred to as a synchronizing assembly, respectively.

In particular, it is advantageous that a physical connection between the locking element and the element of the functional unit, or the locking member of the twin device, respectively, is configured in order to couple to the connection element in terms of motion. In particular, it is thus advantageously possible for there to be no connection established between an actuator of the device for actuation of the locking position of the locking member and the actuator of the twin device. Such an assembly in terms of function is disadvantageous in comparison with a physical connection between the locking member of the device and the locking member of the twin device.

Moreover, it is advantageous that the tensioned position of the force accumulator is unlockable by way of a linear repositioning movement of an actuator element of the device, which interacts with the locking member, in an actuation direction of the actuator element wherein the linear repositioning movement of the actuator element in the releasing direction in relation to a fitted state of the device is performed by way of a movement of the movable furniture part from a predefined closing state of the furniture part on the basic furniture structure in the closing direction, wherein the coupling in terms of motion of the locking member to the functional unit is performed during the movement of the furniture part in the closing direction. To this end, so-called touch-latch assemblies are provided. Rapid and reliable unlocking is thus advantageously achieved. A movement of the furniture part in the closing direction is received by the actuator which is to be distinguished from the locking member. The actuator then carries out an actuation movement in a linear actuating direction, in particular, in the closing direction of the furniture part. By way of the movement of the actuator in the actuating direction, the locking member is completely moved to the unlocking position, this being performed in the releasing direction. It is only after this procedure that the furniture part moves in the opening direction, this being performed so as to be assisted by the force accumulator. This means that, by depressing or excessively depressing the furniture part in the closing direction, respectively, for the actuation procedure, the complete synchronized movement by way of the element of the functional unit is already completed. As soon as the furniture part moves in the opening direction, synchronization according to the present invention is completed.

It is furthermore advantageous that the drive portion in the locking position of the locking member is contiguous to the locking member. Preferably, the drive portion in the locking position of the locking member is biased so as to be biased in the direction of the locking member. The functional reliability of the device is enhanced on account thereof. The drive portion is preferably mounted in a sprung manner. In particular, the drive portion is pivotably mounted.

It is also of advantage that the drive portion is configured on a movable lever which is coupled to the force accumulator. The lever is preferably a guide lever of a coupling installation which couples the force accumulator to an ejector element of the device. The lever moves when the force accumulator moves the furniture part in a force-assisted manner in the opening direction. The drive portion may be present directly on the lever or on a lever attachment, for example. Onward movement of the locking member in the releasing direction is performed, in particular, on a first part distance of the movement of the lever in relation to the movement of the lever in the case of the force-assisted opening of the item of furniture by means of the force accumulator. For example, the first part distance is approx. 5 percent of the total movement path of the movement of the lever in the case of the force-assisted opening of the item of furniture by means of the force accumulator.

An advantageous modification of the subject matter of the present invention is distinguished in that on the connection element, in the region of an external contour, an outwardly projecting engagement portion is molded thereon which interacts with a receptacle portion which is assigned to the locking member in such a manner that in the attached state of the connection element in the case of a releasing movement of the locking member a transmission of movement from the locking member by way of the engagement portion to the connection element is performed. In particular, the connection element bridges the spacing between the device and the functional unit, or between the locking member of the device and the element of the functional unit, respectively. This is advantageous in the case of a rotatable connection element since an advantageous transmission of movement takes place by way of the outwardly projecting engagement portion since an effective lever length between the engagement portion and the rotation axis of the connection element is enlarged. Accordingly, a force acts on the engagement portion when the transmission of movement takes place between the connection element and a counter portion which interacts with the connection element.

In relation to the longitudinal axis of the connection element, the engagement portion preferably projects in a radially outward manner, adjacent regions on the external contour of the connection element thus being radially set back. The engagement portion is preferably molded so as to be uninterrupted along the at least substantial length of the connection element. For example, the engagement portion is molded externally on the connection element in the manner of a bulge or a bead, respectively, so as to run parallel with the longitudinal axis of the connection element.

Alternatively, the outwardly projecting external contour is configured at least across the two end portions of the connection element. In particular, the connection element across the length thereof is configured in a uniform manner, in particular, in an integral manner. This enables the length of the connection element to be individually adapted in a simple manner to a desired length by severing the connection element or by cutting to length, respectively.

It is moreover advantageous that the locking member is pivotably mounted, wherein the releasing movement comprises a pivoting movement of the locking member. In particular, the locking member is pivotable in a biased manner, in particular, so as to be biased in the direction of the locking position. This may be performed, for example, by way of a spring, such as a leaf spring, for example.

A further advantageous modification of the present invention is characterized in that in the attached state the longitudinal axis of the connection element coincides with the pivot axis of the locking member. This is advantageous with a view to a compact and functionally reliable assembly.

In particular, the connection element and the locking member advantageously are mutually adapted in such a manner that the locking member in the case of a releasing movement carries out a pivoting movement. The connection element which is attached to the locking member then carries out a corresponding rotating movement. This rotating movement at the end which is remote from the locking element may be synchronously transmitted to the element of the functional unit, for example, to a locking member of a twin device.

It is also advantageous for two mutually separate engagement portions to be provided on the external contour of the connection element. This enables an optimal transmission of torque from the connection element to the element of the functional unit. The engagement portion and a receptacle portion which is connected thereto may interact while configuring a form-fit and/or a force-fit.

In particular, the engagement portions in relation to an otherwise uniform external contour, in particular, a cylindrical contour, are outwardly projecting. Preferably, precisely two engagement portions which are present in an identical manner and, in particular, so as to be diametrically opposite on the external contour of the connection element are provided.

It is also advantageous for one engagement portion to have an outwardly convex shape.

Moreover, the present invention extends to an item of furniture having a basic furniture structure and a movable furniture part which by way of guide means in relation to the basic furniture structure is movable in an opening direction of the furniture part and in a closing direction which is counter to the opening direction, wherein one of the above-mentioned devices is provided. The advantages discussed may thus be implemented on the item of furniture. In particular, the guide means are a full pullout or a part pullout, having an automatic retraction feature for retracting the furniture part to a fully closed position on the basic furniture structure. Synchronization of a touch-latch function in the case of two lateral guide units is likewise implementable by way of the present invention. The furniture part is configured as a drawer, or as a furniture door, or a furniture flap, for example. In the case of the drawer, two laterally present full pullouts are preferably received so as to be displaceable on mutually opposite sides of the basic furniture structure.

It is furthermore advantageous for a functional unit which is spaced apart from the device to be present, in particular, a twin device, wherein a first end portion of the connection element is connected to the locking member of the device, and a second end portion of the connection element is connected to an element of the functional unit, in particular, to a locking member of the twin device.

BRIEF DESCRIPTION OF THE DRAWINGS

Further features and advantages of the present invention are explained in more detail by means of exemplary embodiments which are schematically illustrated in the figures.

DETAILED DESCRIPTION OF THE INVENTION

Figure 1:
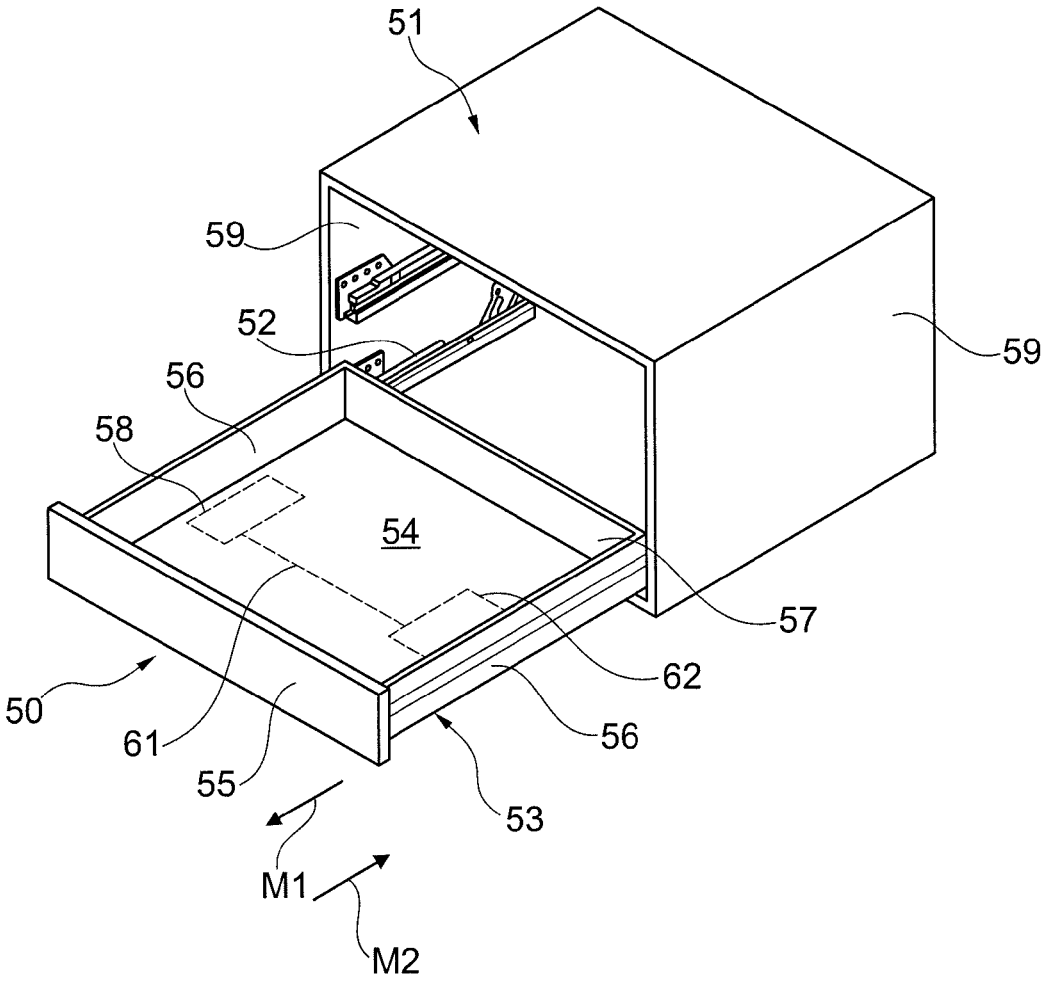
FIG. 1 shows an item of furniture according to the present invention in a perspective view from obliquely above, having a drawer in a completely opened state on a basic furniture structure.

An item of furniture 50 according to the present invention, having a box-shaped basic furniture structure 51 and a drawer 53 which by way of guide means 52 is movably guided, is illustrated in FIG. 1. The drawer 53 comprises a drawer base 54, a drawer front 55, two mutually opposite side walls 56, and a rear drawer wall 57. Two guide means 52 with identical action for guiding the drawer 53 are present in each case between each side wall 56 of the drawer 53 and an associated basic-structure side wall 59. A device 58 according to the present invention (illustrated with dashed lines), for moving or ejecting, respectively, the furniture part which is configured as a drawer 53 in the opening direction M1 is disposed on a lower side of the drawer base 54.

Figure 2:
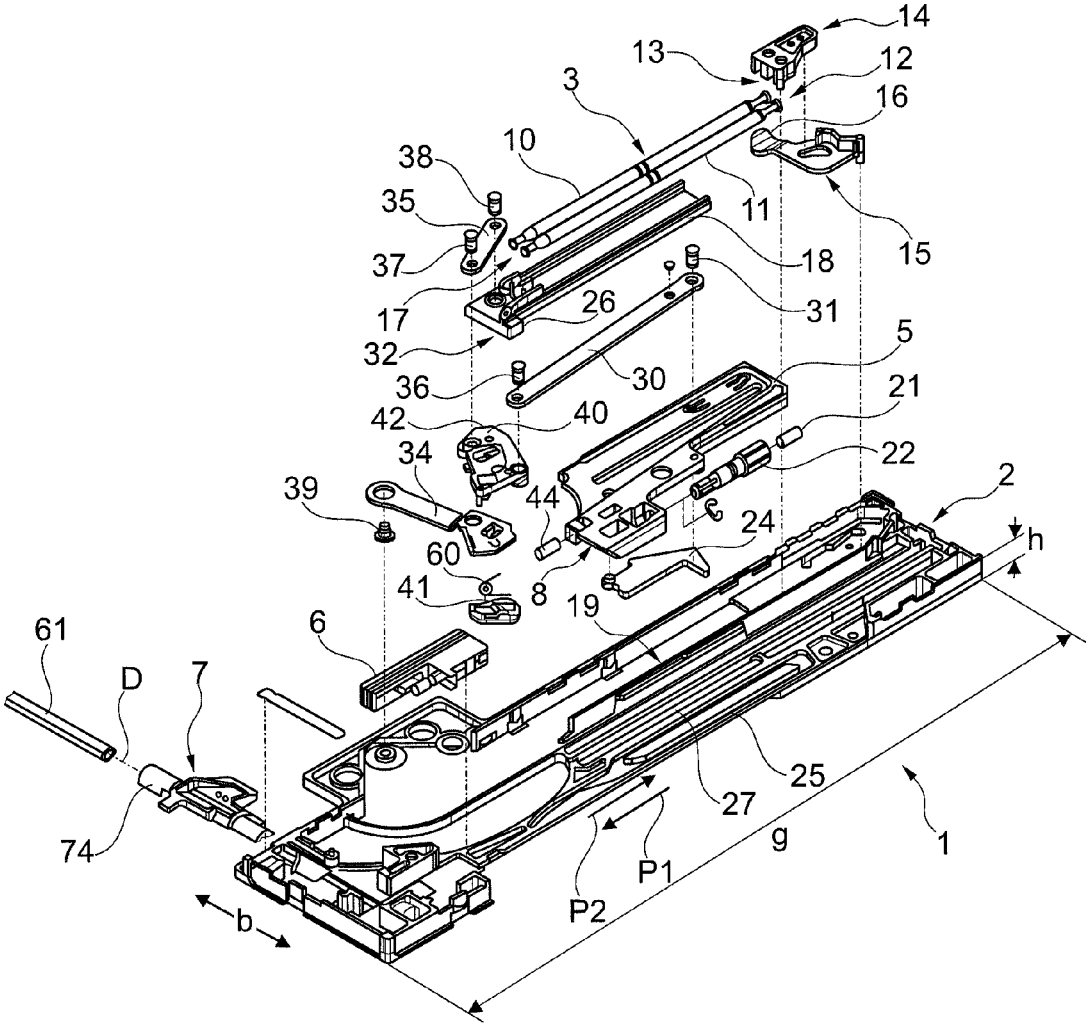
FIG. 2 shows a device according to the present invention, without a cover component, in an exploded illustration.

FIG. 2 shows the exploded illustration of the device 58 which is configured as an ejector unit 1 for the drawer 53.

The ejector unit 1 serves for the force-assisted ejection of the drawer 53 across a first part-distance of the opening movement of the drawer 53 in relation to the basic furniture structure 51, from a closed position in the opening direction M1 of the drawer 53.

The drawer 53 by way of the guide means 52, for example, two identical part-pullout units or full-pullout units, is mounted on the basic furniture structure 51 so as to be displaceable in the directions M1 and M2.

Alternatively, the ejector unit 1 may be disposed on the basic furniture structure 51 or on the guide means 52 of the item of furniture 50.

The ejector unit 1 comprises inter alia a base plate 2, a force accumulator 3, a coupling installation 4, an ejector 5, an activation element which is configured as an activator 6, and a locking member 7.

Figure 9:
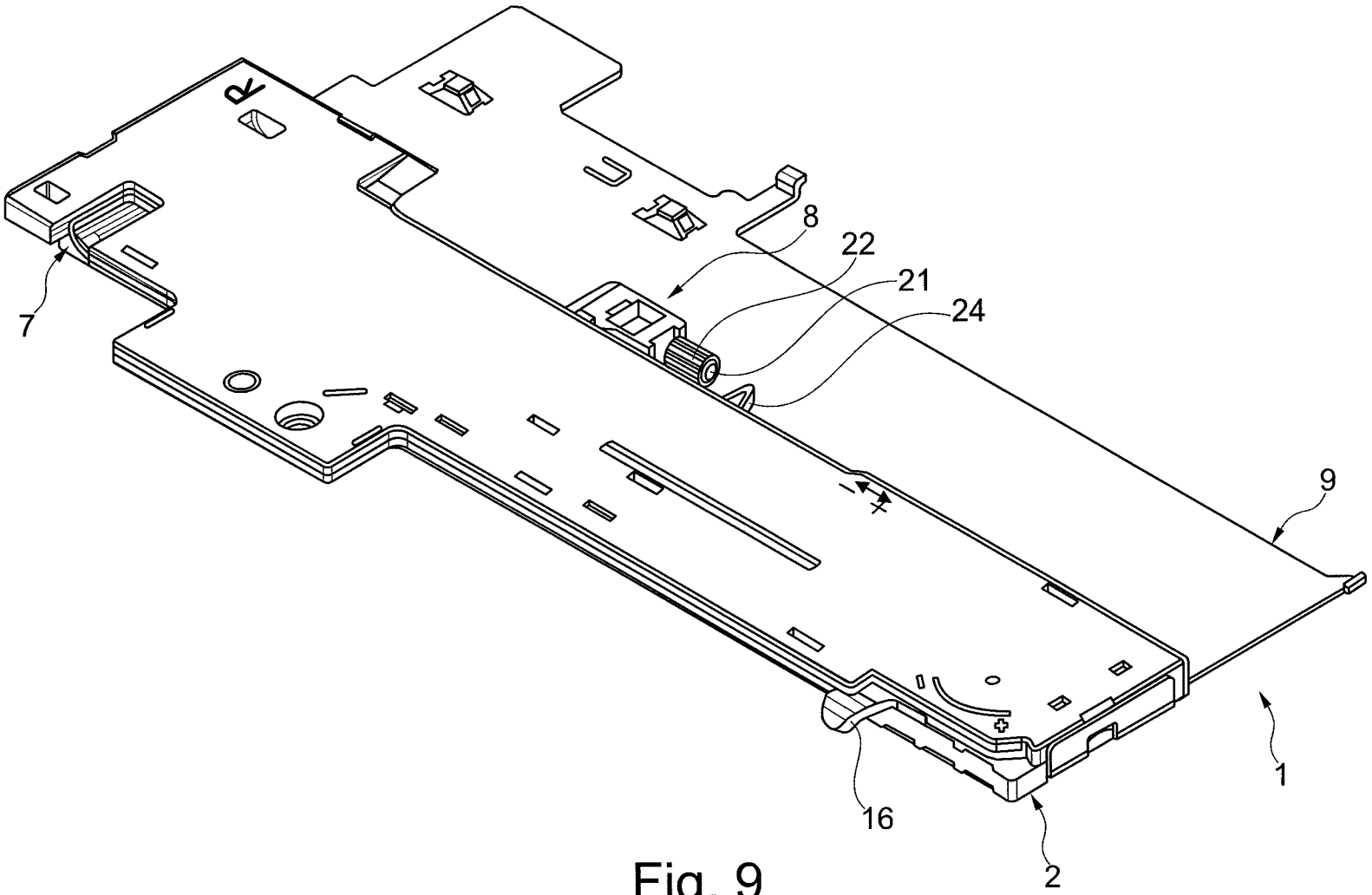
FIG. 9 shows the device according to FIG. 5, having a cover component, in a perspective view from obliquely below toward a second main side of the device.

A housing of the ejector unit 1 comprises the base plate 2 and a cover component 9 which is visible in FIG. 9. The ejector unit 1 may be disposed on the lower side of the drawer base 54 and/or on the guide means 52 by way of the housing or by way of the cover component 9 and/or the base plate 2, respectively.

Retaining portions, guide contours, stop members, and/or receptacle portions for linking the individual components of the ejector unit 1 are configured on the base plate 2. The base plate 2 is designed substantially as a rectangular, elongate or strip-shaped component, having a comparatively minor height h of approx. 5 to 15 millimeters, for example. The base plate 2 furthermore has a width b of approx. 4 to 10 centimeters, and a length g.

According to the exemplary embodiment shown, the force accumulator 3 comprises two identical coil springs 10, 11 which configure a spring pack and which are disposed in parallel. At a first end 12 of the force accumulator 3, the coil springs 10, 11 are disposed on an adjustable fixed mounting 13. The fixed mounting 13 comprises a movable mounting part 14 on which the coil springs 10, 11 are received in a releasable yet fixed manner, and a set part 15 having an operating portion 16 by way of which a user may adjust from the outside a position of the end 12 of the force accumulator 3 in a modifiable and positionally fixed manner. On account thereof, an effect of force of the force accumulator 3 on the drawer 53 may advantageously be pre-adjusted in the case of the opening procedure of the drawer 53.

The associated ends of the coil springs 10, 11 are fastened to a slide-type motion element 18 at a second end 17 of the force accumulator 3. The slide-type motion element 18 by way of an associated guide contour 19 is linearly guided on the base plate 2 so as to be movable in a movement direction P1 and in an opposite movement direction P2.

The movement directions P1 and P2 of the motion element 18 (cf. FIGS. 2 and 3) run parallel with the opening direction M1 of the drawer 53 and with a closing direction M2 which is counter thereto.

If and when the ejector unit 1 is disposed in a positionally fixed manner on the basic furniture structure 51 and/or on a stationary part of the guide means 52, the opening direction of the drawer 53 corresponds to the direction P1, and the closing direction of the drawer 53 corresponds to the direction P2.

Herebelow, an assembled state of the ejector unit 1 on the drawer base 54 is assumed.

Figure 3:
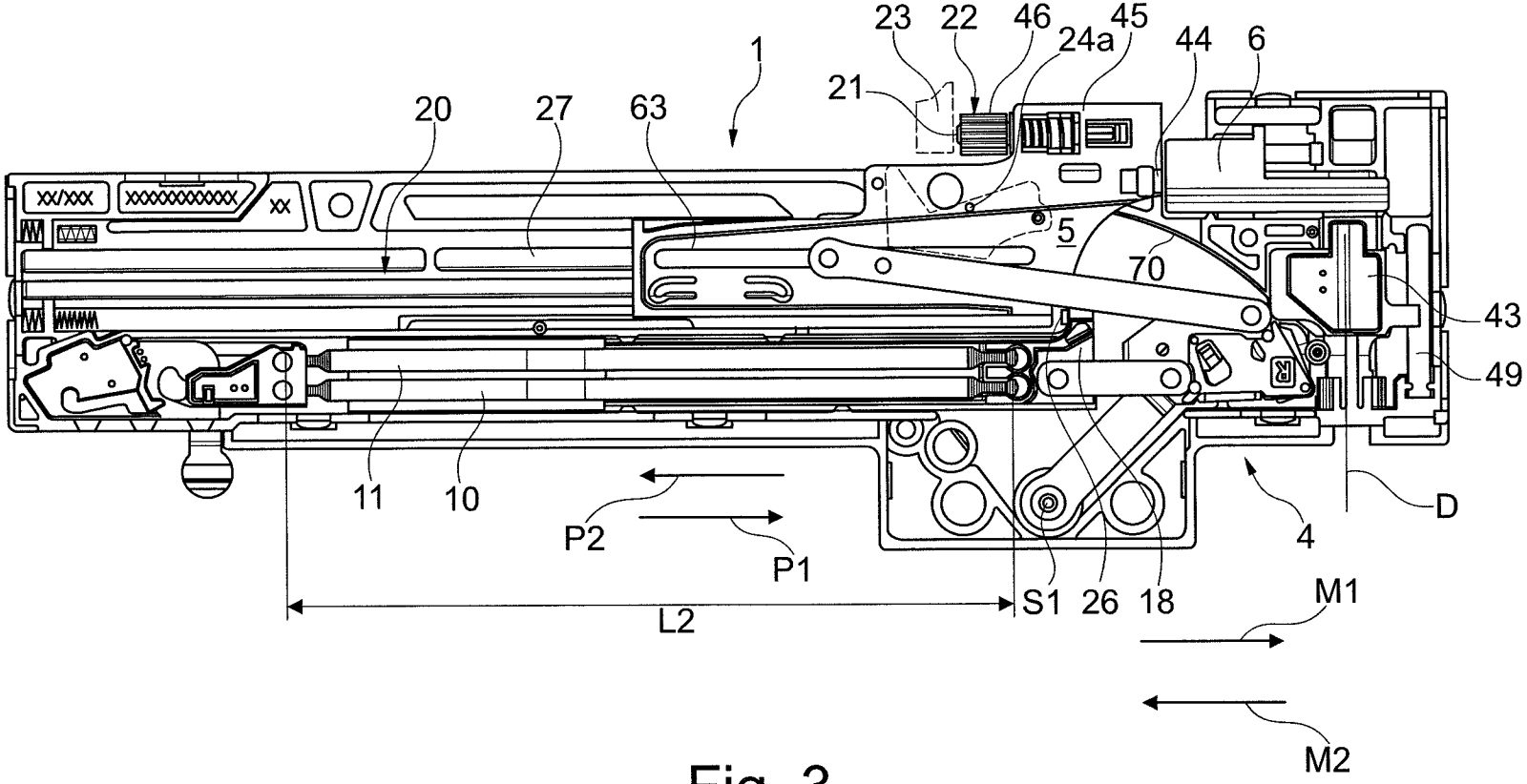
FIGS. 3 to 8 show the device according to FIG. 2, in an assembled state, in a plan view of a first main side, in various operational states.
Figure 7:
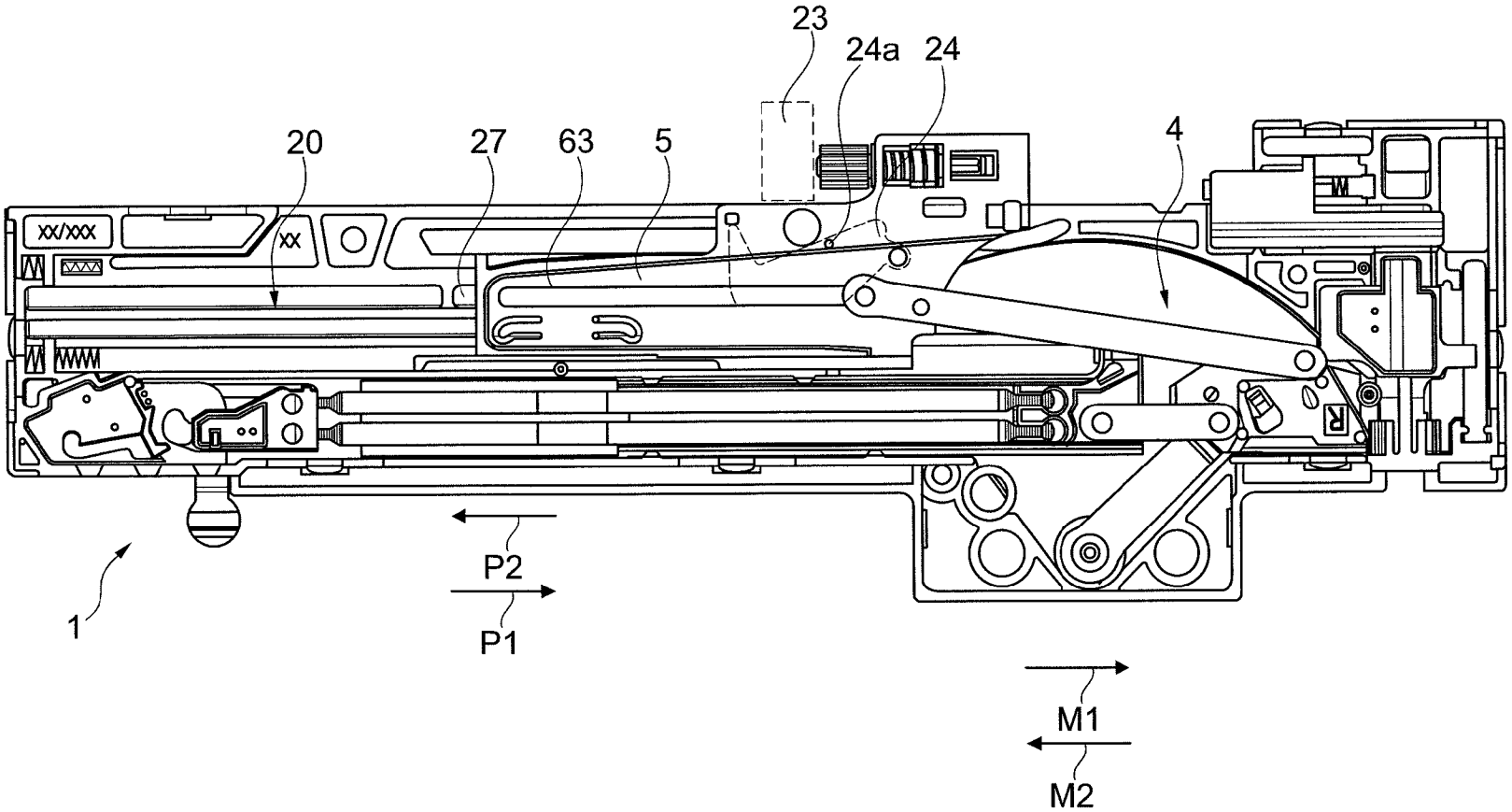
Figure 8:
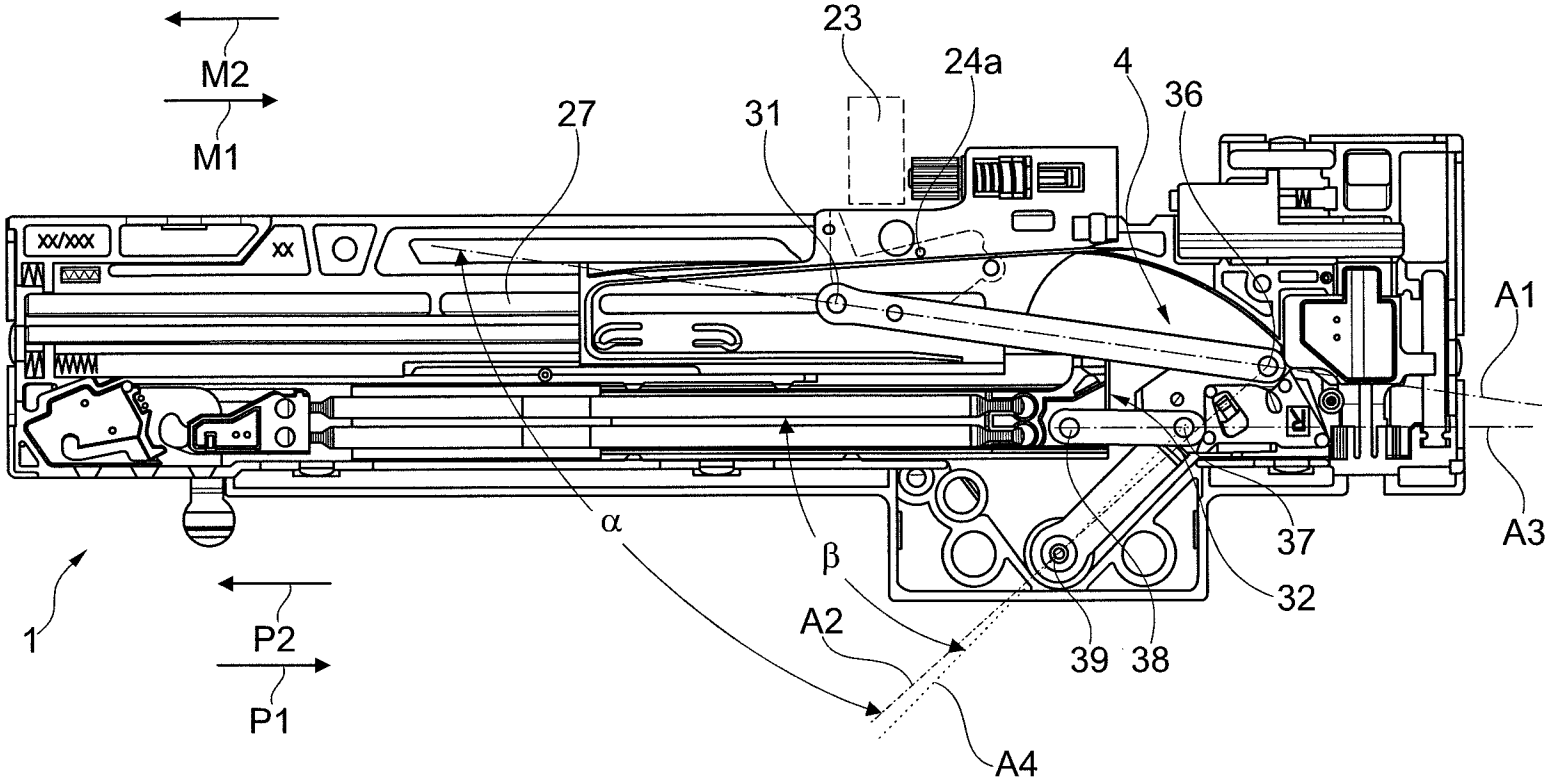

FIGS. 3, 7 and 8 show the ejector unit 1 in a tensioned state of the force accumulator 3, in which the coil springs 10, 11 are elongated or are tensioned so as to be under a tensile load, respectively; herein, motion element 18 in relation to a retracted position in the direction P2 is offset on the base plate 2 in the direction P1 and is retained in a tensioned position.

Figure 5:
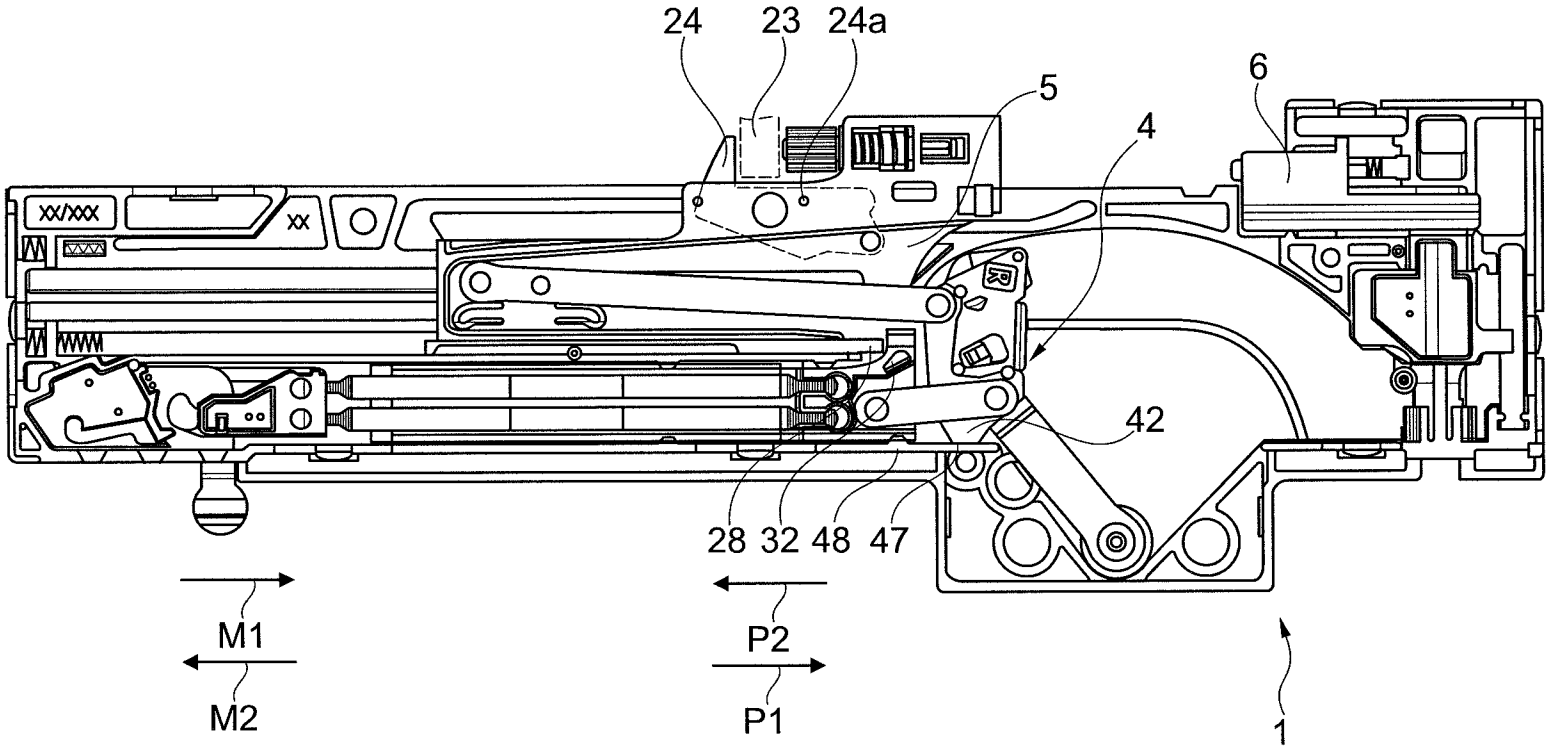
Figure 6:
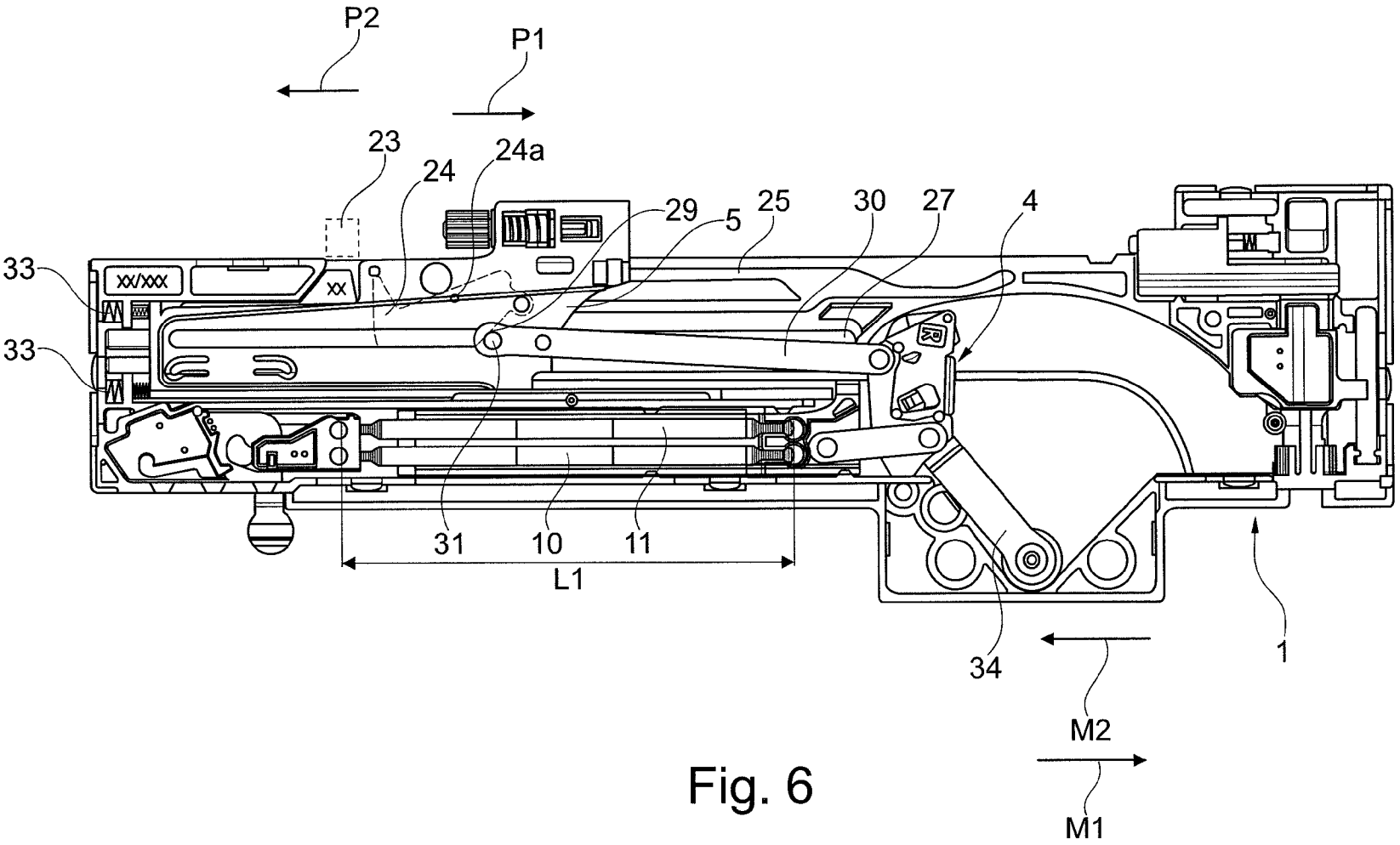

FIGS. 5 and 6 show the ejector unit 1 in a discharged basic state of the force accumulator 3, in which the coil springs 10, 11 are furthermore biased under a tensile load but to a lesser degree, and have a length L1.

In the tensioned state of the force accumulator 3 the coil springs 10, 11 have a length L2 which is greater than L1.

A retaining member 32 having a stop element 26 is present on the motion element 18. The stop element 26 in the case of a force-assisted opening procedure is in contact with an ejector 5.

By way of a coupling installation 4, the force accumulator 3 or the motion element 18, respectively, is operationally connected to the ejector 5, preferably exclusively in the case of the closing procedure of the drawer 53. The ejector 5 is movable to and fro in the directions P1 and P2, in particular, exclusively movable in a linear manner, or so as to be parallel with the movement direction of the motion element 18, respectively. To this end, a linear guide 20 which is adapted to guide portions, for example, on one side of the ejector 5, is configured on the base plate 2.

Figure 4:
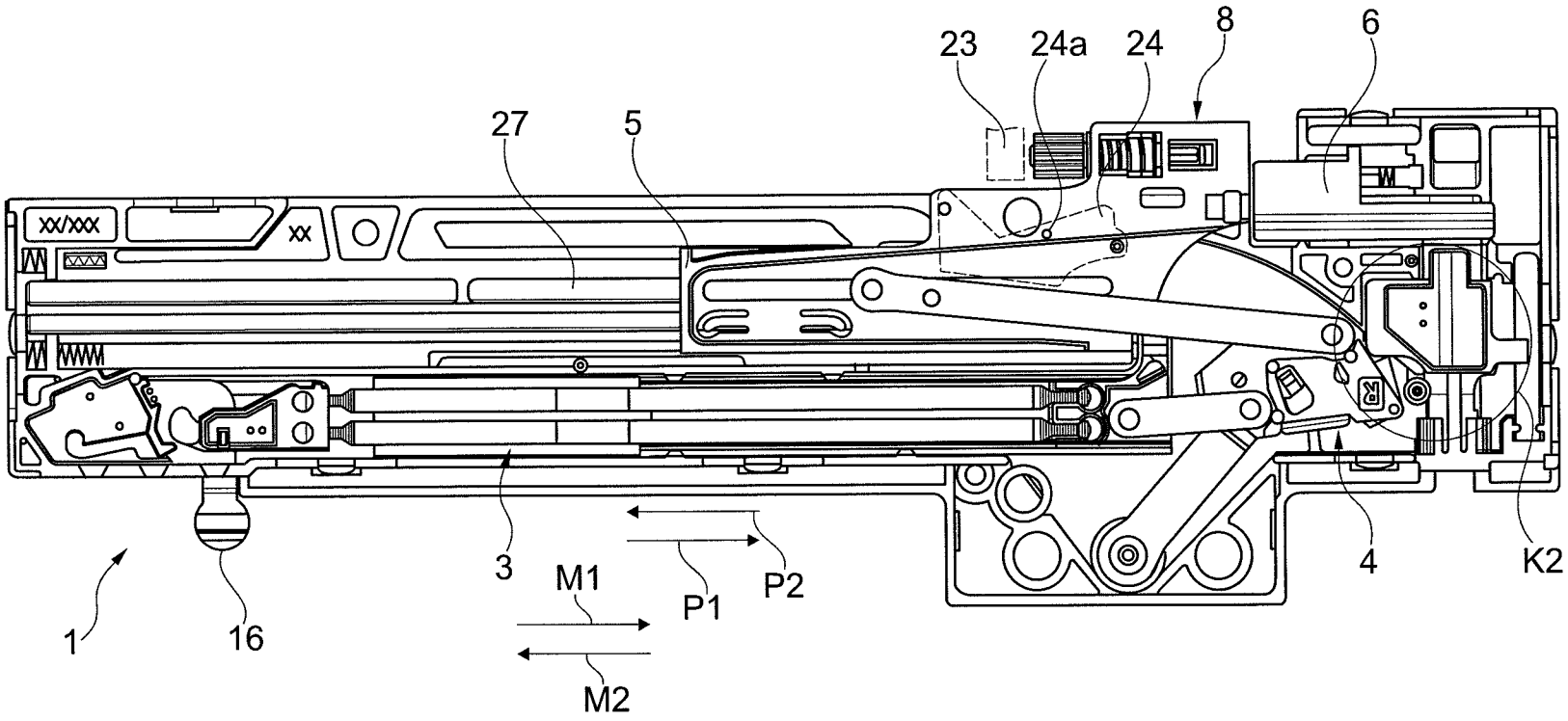

An opening procedure of the drawer 53, caused by the ejector unit 1, takes place exclusively by way of a direct operational connection of the force accumulator 3 to the ejector 5, by way of the motion element 18 which moves in the direction P2. To this end, a stop element 26 which is advantageously designed so as to be elastic and thus prevents or at least dampens any sound which is disturbing to a user when the motion element 18 impacts the ejector 5 in the opening procedure of the drawer 53 is configured on the motion element 18 (FIGS. 3, 4 and 5).

A front-gap adjustment assembly 8 which is configured on the ejector 5 comprises a housing 45 and a set screw 22 having a contact portion 21. The set screw 22 has an external thread which interacts with an internal thread on the housing 45. Depending on the rotation direction, a position of the contact portion 21 of the set screw 22 is adjustable in the direction P1 or P2 by manual rotation of an operating portion 46 of the set screw 22 by a user. In particular, the set screw 22 is configured so as to be self-locking in relation to the housing 45. A measure of a front gap between the drawer front 55 of the drawer 53, which is closed on the basic furniture structure 51, and end sides of the basic furniture structure 51 is capable of being predefined by way of the predefined position of the set screw 22.

The contact portion 21 of the set screw 22 in the tensioned or charged state, respectively, of the force accumulator 3 bears on an entrainment element 23 which in respective operational states forms a stop for the contact portion 21. The entrainment element 23 which in FIGS. 3 to 8 is merely indicated by dashed lines may be present on a fixed rail of the guide means 52, for example, or be attached to the basic furniture structure 51 when the ejector unit 1 is disposed on the drawer 53.

However, if and when the ejector unit 1 is disposed on the basic furniture structure 51 or on a positionally fixed part of the guide means 52 of the item of furniture 50, the entrainment element 23 may be present on the drawer 53 and thus be movable in relation to the basic furniture structure 51.

If and when, proceeding from the basic position of the ejector unit 1 according to FIG. 3, a locking feature is cancelled on the ejector unit 1, as is shown in FIG. 4 and will be explained in more detail below, the tensioned or charged force accumulator 3, respectively, pulls the motion element 18 in the direction P2, the latter by way of the stop element 26 urging or sliding, respectively, the ejector 5 in relation to the base plate 2 in the direction P2.

As soon as the ejector 5 on the base plate 2 moves in the direction P2, a latch component 24 of the ejector unit 1, which is pivotably mounted on the ejector 5, is put from an inwardly pivoted position according to FIG. 4, in which the latch component 24 in relation to an external periphery of the base plate 2 is completely retracted, to an outwardly pivoted position in which the latch component 24 by way of a lug partially projects beyond the external periphery of the base plate 2 (FIG. 5), this being implemented by way of a loop-shaped closed guide track 25 in the base plate 2 and by way of a guide pin 24*a*, engaging in the guide track 25, on the latch component 24.

In order for the latch component 24 to be illustrated, the outline thereof which is obscured by other components, in particular, by the ejector 5, in FIGS. 3 to 8 is indicated with dashed lines.

In the basic state which is illustrated in FIG. 5, the force accumulator 3 is located in a terminal position of the discharged state, wherein the force accumulator 3 is unable to move the ejector 5 any farther in the direction P2.

By virtue of the kinetic energy of the drawer 53, caused by the preceding ejection movement, and/or by manually moving the drawer 53 farther in the opening direction M1 by a user, the ejector 5 is subsequently displaced in relation to the base plate 2 in the direction P2. This is possible because the latch component 24 which has been outwardly pivoted so as to project from the ejector 5 bears on the entrainment element 23, the ejector 5 in the further course of the movement of the drawer thus reaching the terminal position thereof which is displaced to a maximum in the direction P2 on the base plate 2. By reaching the terminal position on the ejector 5, the latch component 24 is again completely pivoted inwardly, this being predefined by the interaction between the guide track 25 and the guide pin 24*a* engaging therein on the latch component 24.

If and when the drawer 53 following a discharging procedure of the force accumulator 3 is moved farther in the opening direction M1, the ejector unit 1 separates from the entrainment element 23, cancelling contact between the entrainment element 23 and the contact portion 21 of the set screw 22 (FIG. 6).

From the terminal position described above, which the ejector assumes only briefly, the ejector 5 by spring elements 33 on the base plate 2 is urged by a few millimeters in the direction P1, for example. In relation to the coil springs 10, 11 of the force accumulator 3, the spring elements 33 have a comparatively minor force. By way of the movement of the ejector 5 in the direction P1 by way of the force of the spring elements 33, a bearing portion 29 of the latch component 24 in a standby position of the ejector 5 is put in direct clearance-free contact with a mounting pin 31 of a tension lever 30 of the coupling installation 4 (FIG. 6). The mounting pin 31 is disposed on a first end of the tension lever 30 and may move freely along a, for example, linear, guide track 27 and/or a linear guide 63 which is configured on the ejector 5 for so long, and, in particular, within an opening procedure of the drawer 53, until the latch component 24 holds the mounting pin 31 and/or the tension lever 30 in direct, clearance-free contact with the ejector 5.

The standby position of the ejector 5 which is shown in FIG. 6 at the same time is also a starting position of the ejector 5 for a charging procedure of the force accumulator 3 by way of the coupling installation 4.

Besides the tension lever 30, the coupling installation 4 comprises a guide lever 34 and a connection element 35. By way of a mounting pin 36, the tension lever 30 on a second end is articulated on the guide lever 34. The connection element 35, on a second end, by way of a mounting pin 37 which is spaced apart from the mounting pin 36, is likewise articulated on the guide lever 34, and on the first end thereof, the connection element 35 by way of a further mounting pin 38 is articulated on the motion element 18. The guide lever 34 at a first end by way of a mounting pin 39 is disposed so as to be movable, in particular, pivotable, on the base plate 2. The mounting pin 39 is preferably received both on the base plate 2 as well as on the cover component 9.

A longitudinal axis A1 of the tension lever 30, which runs through the mounting pins 31, 36 of the tension lever 30, in relation to a first longitudinal axis A2 of the guide lever 34, which runs through the mounting pins 36, 39, has an angle $\alpha$.

A longitudinal axis A3 of the connection element 35, which runs through the mounting pins 37, 38 of the connection element 35, in relation to a second longitudinal axis A4 of the guide lever 34, which runs through the mounting pins 37, 39, has an angle $\beta$.

The guide lever 34 of the coupling installation 4, on a second end, comprises a lever attachment 40. A locking element 41 and a stop element 42 are configured on the lever attachment 40.

The terminal position of the discharged state of the force accumulator 3 (FIG. 5) is predefined, in particular, by a stop of the guide lever 34 on a wall portion 28 of the base plate 2, and/or by a stop of the stop element 42 on a wall portion 47 on a web-type wall 48 of the base plate 2. The wall portion 47 is formed from an annular portion of a damping element, for example. If and when the stop element 42 of the guide lever 34 following a discharging procedure of the force accumulator 3 bears on the wall portion 47, by virtue of a remaining bias of the coil springs 10, 11 a tensile force in the direction P2 is transmitted from the motion element 18 by way of the connection element 35 to the guide lever 34. By virtue of the rigid embodiment of the coupling installation 4, or by virtue of the impact of the stop element 42 on the wall portion 47, respectively, the motion element 18 is prevented from moving farther in the direction P2, wherein the force accumulator 3 by way of the motion element 18 is held free of clearance in the terminal position of the discharged state.

In particular, the stop element 42 and/or the wall portions 28, 47 may be designed so as to be elastic or damping, respectively, thus reducing or preventing an impact noise.

When tensioning the force accumulator 3, the guide lever 34 by virtue of the design thereof may transmit a force from the tension lever 30 to the connection element 35 at a geared up ratio.

The geared up transmission ratio is formed, on the one hand, by the ratio of the spacing of the mounting pins 39 and 36 in relation to the spacing of the mounting pins 39 and 37 on the guide lever 34 and, on the other hand, by the combined mutual circular and linear movement of the tension lever 30 and/or of the connection element 35 during the charging procedure of the force accumulator 4.

The elements of the coupling installation 4, by virtue of the arrangement of the former on the ejector unit 1, may move as follows:

The mounting pin 31 and thus the first end of the tension lever 30, by virtue of the mounting thereof in the guide track 27, may move exclusively parallel with a movement direction of the ejector 5, in particular, parallel with a movement direction of the movable furniture part 53.

The mounting pin 38 and thus the first end of the connection element 35, by virtue of the mounting thereof on the slide-type motion element 18 and thus advantageously in the guide contour 19, may move exclusively parallel with a movement direction of the motion element 18 or of the ejector 5, respectively, in particular, parallel with the movement direction of the movable furniture part 53.

The mounting pin 36 and thus the second end of the tension lever 30, by virtue of the mounting thereof at the second end of the guide lever 34, may move exclusively in a circular path about a rotation center of the mounting pin 39 of the guide lever 34.

The mounting pin 37 of the connection element 35 and thus the second end of the connection element 35, by virtue of the mounting thereof in a central region of the guide lever 34, may move exclusively in a circular path about a rotation center of the mounting pin 39 of the guide lever 34.

By virtue of the above-mentioned design, the coupling installation 4 may transmit at a geared up ratio a force for tensioning the force accumulator 3 from the ejector 5 by way of the tension lever 30 and of the guide lever 34 to the connection element 35 and thus to the force accumulator 3, and, in particular, the coupling installation 4 transmits the force which is exerted by the ejector 5 in a geared down ratio to the force accumulator 3. This means that a user when charging the force accumulator 3 has to apply less force to the ejector 5 than the user would have to apply when wishing to charge the force accumulator 3 without a geared down ratio, or when directly pulling the end 17 of the force accumulator 3 in the direction P1, respectively.

The beginning and the end of the charging procedure of the force accumulator 3 or of the coil springs 10, 11, respectively, is visualized in FIGS. 6 and 7.

Tensioning of the force accumulator 3 is performed by a movement of the drawer 53 in the case of closing, or on a part-distance of the closing movement of the drawer 53. The starting position of the ejector unit 1, in which the latter is prepared for tensioning of the force accumulator 3 and expects a closing procedure of the drawer, is shown in FIG. 6.

If and when the drawer 53 is closed, for example, from the outside by a user, the ejector unit 1 moves in the direction M2 toward the entrainment element 23. The charging procedure of the force accumulator 3 begins as the contact portion 21 of the set screw 22 of the ejector 5 impacts on the entrainment element 23. The ejector 5, by impacting on the entrainment element 23, is moved in the direction P1, for example, by virtue of the inertia of the drawer 53 in relation to the base plate 2.

By way of the coupling of the ejector 5 to the force accumulator 3 by way of the coupling installation 4, the motion element 18 of the force accumulator 3 is likewise displaced in relation to the base plate 2 in the direction P1, and the second end 17 of the coil springs 10, 11 is displaced in the direction P1, the coil springs 10, 11 thus being elongated.

At the end of the tensioning procedure of the force accumulator 3, the ejector 5 is located in a terminal charging position, as is shown in FIG. 7. In the tensioned state of the force accumulator 3, the ejector unit 1 is located in a locked state.

In the locked state, a locking state is determined by the locking element 41 of the coupling installation 4 and by the locking member 7 which is configured as a flap, wherein a discharging movement of the coupling installation 4 is blocked by the locking member 7.

Tensioning of the force accumulator 3 is fully completed prior, for example, to an automatic retracting feature for the force-assisted retraction of the drawer 53 into the fully closed closing position on the basic furniture structure 51 becoming effective. The automatic retracting feature is not part of the ejector unit 1, and is integrated, for example, in the guide means 52 or in the part-pullout units or full-pullout units, respectively.

After the force accumulator 3 has been tensioned, the ejector 5 by virtue of bearing on the entrainment element 23 is moved in the direction P1 in relation to the base plate 2 by way of the further closing movement of the drawer 53. Herein, the operational connection between the latch component 24 of the ejector 5 and the mounting pin 31 of the tension lever 30 is cancelled. This is performed by an interaction between the guide track 25 and the guide pin 24*a* on the latch component 24, wherein the latch component 24 by the guiding of the guide pin 24*a* in the guide track 25 is pivoted away from the mounting pin 31 (FIG. 8). In this state, the ejector 5 is uncoupled from the coupling installation 4 and is displaceable so far in the direction P1, in particular, by an automatic retracting feature, until the drawer 53 is fully closed on the basic furniture structure 51, and the ejector 5 bears on the activator 6 in the basic position according to FIG. 3.

In the basic position of the ejector unit 1 according to FIG. 3, it is possible for a user to manually pull the drawer 53 in the opening direction M1 without an ejector function or without first cancelling the locking state, respectively. Herein, the force accumulator 3 of the ejector unit 1 is non-actuated or charged, respectively.

In order for the drawer 53 by way of the ejector unit 1 to be expelled from the position in which the drawer 53 is completely retracted or closed, respectively on the basic furniture structure 51, a user has to act on the drawer while pushing from the outside in the direction M2. To this end, the ejector unit 1 has a so-called touch-latch function which knows a locked state which is unlockable in that the retracted drawer 53 which is closed and retracted on the basic furniture structure 51 is moved in the closing direction M2. This closing movement, or inwardly pushing of the drawer 53 in the direction M2, respectively, is performed until a stop position corresponding to a front gap which in the closed state of the drawer 53, is predefined, in particular, by way of a spacing between an internal side of the drawer front 55 and a forward end side or the side walls 56 of the basic furniture structure 51, respectively, is reached. The front gap is typically a few millimeters, for example, approx. 1 to 10 millimeters.

Accordingly, unlocking of the ejector unit 1 is adapted in such a manner that a closing movement of the drawer 53 in the direction M2 of a few millimeters, or at maximum by the value of the front gap, respectively, is sufficient for unlocking and thus the force-assisted ejection of the drawer 53 to be reliably predefined.

Proceeding from the basic position according to FIG. 3, the ejector unit 1 together with the drawer 53 is moved in the direction M2. Since the set screw 22 bears on the entrainment element 23, the ejector 5 is moved in relation to the base plate 2 in the direction P1, a contact portion 44 on the ejector 5 thus pressing against the activator 6, accordingly pushing the latter in the direction P1. The activator 6 is present on the base plate 2 so as to be linearly displaceable in a limited manner, typically by a few millimeters or by less than the dimension of the front gap, respectively, in the directions P1 and P2.

The activator 6 is preferably directly coupled to the locking member 7 which is designed as a flap 43 in such a manner that the linear activation movement of the activator 6 in the direction P1 sets the flap 43 in rotary motion about a pivot axis D. The flap 43 by the rotating movement is released from a locking position into which the flap 43 is urged by a spring member which is configured as a leaf spring 49. In the locked state of the ejector unit 1, the flap 43 which is located in the locking position blocks the guide lever 34 or the lever attachment 40, respectively, in such a manner that the force accumulator 3 remains in the charged state thereof.

Blocking of the guide lever 34 is cancelled by the rotating movement of the flap 43. The locking element 41 on the lever attachment 40, which is biased by a leg spring 60, hereby preferably pivots out.

The locking element 41, which projects from the lever attachment 40, moves conjointly with the pivoting procedure of the guide lever 34 below the flap 43, past the latter, and continues without interruption the rotating movement of the flap 43, initiated by the activator 6, about the pivot axis D. On account thereof, a rotation angle of the flap 43 out of the locking position is advantageously enlarged. The ejector unit 1 is reliably unlocked by the movement of the lever attachment 40 below and past the flap 43 and continued by the outwardly pivoting locking element 41. To this end, a comparatively very minor linear activation movement of the activator 6 in the direction P1 is advantageously required. Subsequently, the cap 43 by the leaf spring 49 is urged back into the locking position of the former.

The locking element 41 which is present so as to be outwardly pivoted on the lever attachment 40 is again brought to bear on a front edge of the flap 43 when the force accumulator 3 is tensioned. Herein, the locking element 41 yields counter to the spring force of the leg spring 60, such that the locking element 41 is retracted so far on a periphery of the lever attachment 40 that the guide lever 34 by way of the lever attachment 40 can pivot past the flap 43.

Behind the flap 43, the locking element 41 is outwardly pivoted again by the spring force of the leg spring 60. Following the tensioning procedure, the guide lever 34 by way of the projecting locking element 41 is pushed against the flap 43 which is held by the leaf spring 49 so as to lock, the force accumulator 3 thus being in the locked state.

The rotating movement of the flap 43 of the ejector unit 1, or of the device 58, respectively, is transmitted by a synchronizer bar 61 which is disposed so as to be rotationally fixed on the flap 43 to a second device 62 which is advantageously of identical action and which is disposed on the drawer 53.

The synchronizer bar 61 advantageously connects the locking member 7 to a second locking member which is present on the second device 62. The two locking members are thus directly and/or synchronously coupled in terms of motion. This represents a synchronizing principle which is contrary to a physical connection between actuator elements of two ejector units on one furniture part.

Figure 10:
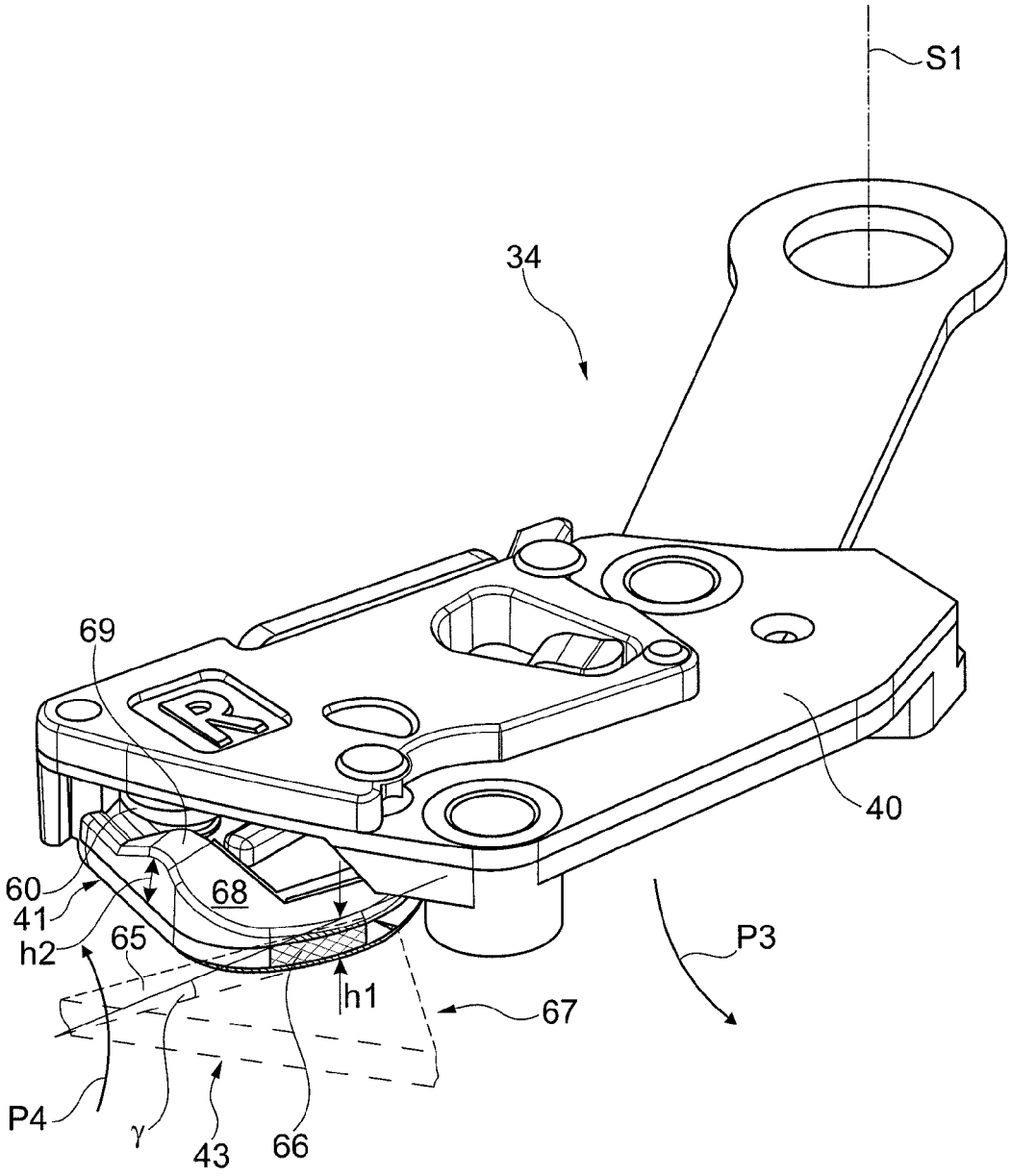
FIG. 10 in a perspective and enlarged manner shows a guide lever in the state according to FIG. 3, wherein an outline of part of a locking member is indicated by dashed lines.

FIG. 10 in a perspective manner shows the guide lever 34 having the lever attachment 40 and the locking element 41 having the leg spring 60 in an enlarged manner, wherein an outline of part of a wing-type appendage 67, acting in a locking manner, of the flap 43 is indicated being in the locking state or in bearing contact with the locking element 41 according to the state of FIG. 3, respectively.

The flap 43 which by way of the leaf spring 49 is urged to the locking state locks the guide lever 34 in relation to a pivoting movement of the guide lever 34 in the direction P3 about the pivot axis S1 of the guide lever 34. Under the action of the force accumulator 3 which is in the tensioned state, the guide lever 34 is biased in the direction P3. Herein, the locking flap 43 by way of part of a peripheral narrow side 65 of the appendage 67 forms a mechanical stop for a narrow end-side portion 66 on the locking element 41. The portion 66 in FIG. 10 is highlighted with hatched lines.

Figure 11:
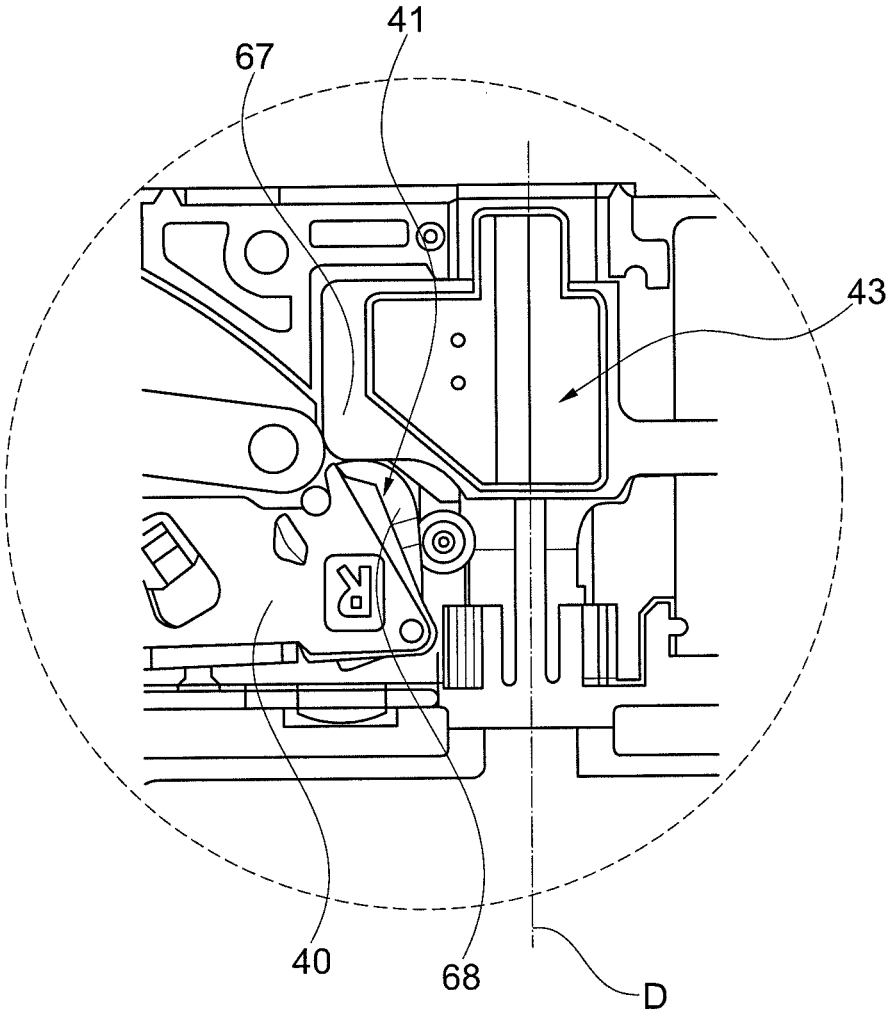
FIG. 11 shows an enlarged fragment according to the region K1 of FIG. 3.

FIG. 11 shows this state according to FIG. 3. When the flap 43, following an actuation procedure, is upwardly pivoted about the axis D in the direction P4 and the locking state is thus cancelled in that the narrow side 65 by way of the flap 43 is moved away from the portion 66, the guide lever 34 pivots in the direction P3, the force-assisted opening movement of the drawer 53 being thus performed.

Pivoting the flap 43 from the locked position in the direction P4 in relation to the respective part of the narrow side 65 on the portion 66, is performed by a few angular degrees, for example, by 5 to 10 angular degrees, or by the angle gamma, respectively, or γ, respectively, this depending on the height dimension h1 of the portion 66 of approx. 1 millimeter, for example. The height of the narrow side 65 preferably corresponds to at least approximately the height h1. Following upward pivoting of the flap 43 in the direction P4 about the angle γ, the locking element 41 moves past below the appendage 67, wherein, under participation of the leaf spring 49 which urges the flap 43 counter to the direction P4, a lower side of the appendage 67 is supported on an upper side of the locking element 41. The upper side of the locking element 41 which on the lower side acts on the appendage 67, has an obliquely aligned drive portion 68 such that the flap 43, in a corresponding manner to the obliqueness of the drive portion 68, is further lifted in the direction P4. The obliqueness of the drive portion 68, counter to the direction P3, increases from the portion 66 up to a crest 69 at the top of the locking element 41. Further lifting of the flap 43 by the locking element 41 is performed over the height h2, according to the height of the drive portion 68, or further upward pivoting is preferably performed about a pivoted distance in the range of the angle γ or about somewhat more than the latter, respectively. The flap 43 is thus pivoted in the direction P4 by at least 2*γ.

When the guide lever 34, or the locking element 41, respectively, has been pivoted past the flap 43 or the appendage 67, respectively, the flap 43 is returned from the pivoted position in which the latter is pivoted to the maximum in the direction P4, or is lifted to the maximum, respectively, to the locking position according to FIG. 10 or 11, respectively with resistance from the leaf spring 49. The locking element 41 which by way of the leg spring 60 has been moved to be position according to FIG. 10, in which the locking element 41 in relation to a periphery of the lever attachment 40 is protruding, by way of bearing on a web step 70 which runs in a curved manner on the base plate 2 (cf. FIG. 3), during further pivoting in the direction P3 is pushed inward such that the locking element 41 still projects from the lever attachment 40 only to a minor extent. The retreated position of the locking element 41 is maintained by the continuous configuration of the web step 70 across the entire subsequent pivoting patch of the guide lever 34 in the direction P3, and during later pivoting back of the guide lever 34 in the direction counter to P3 when tensioning the force accumulator 3, until the locking element 41 passes the appendage 67 and behind the latter, under the action of the leg spring 60, again pivots to the locking position according to FIG. 3 or 11, respectively, and the guide lever 34 in the direction P3 is blocked by the narrow side 65.

Figure 12:
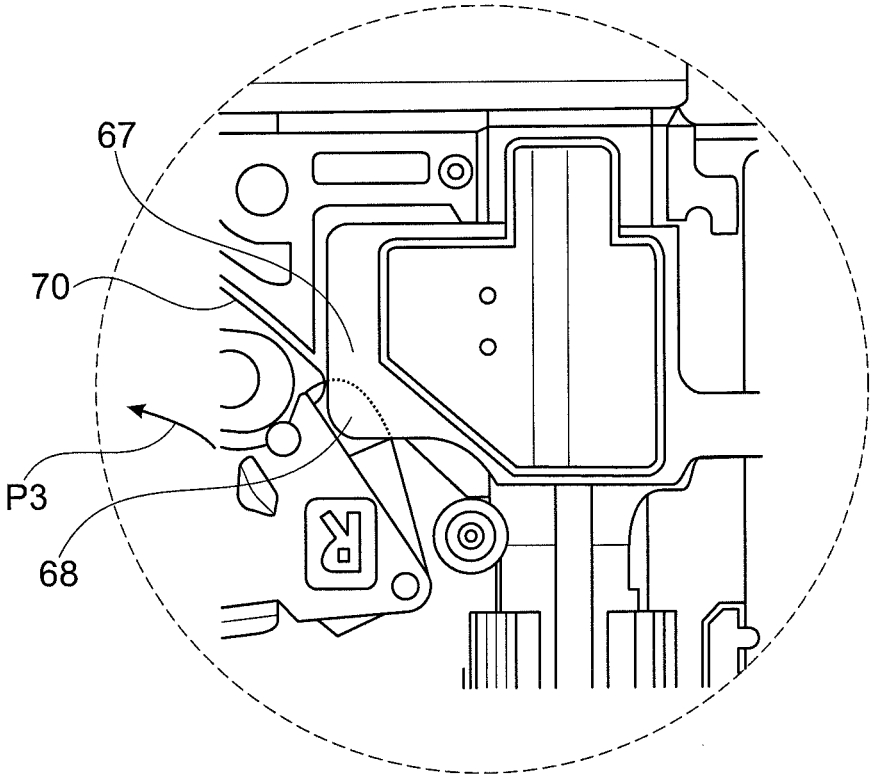
FIG. 12 shows an enlarged fragment according to the region K2 of FIG. 4.

FIG. 12 relates to the moment when the flap 43 by means of the locking element 41 is underridden or lifted, respectively, shortly after the locking position of the guide lever 34 has been unlocked. The outline of the locking element 41 below the appendage 67 is indicated with dashed lines.

Figure 13:
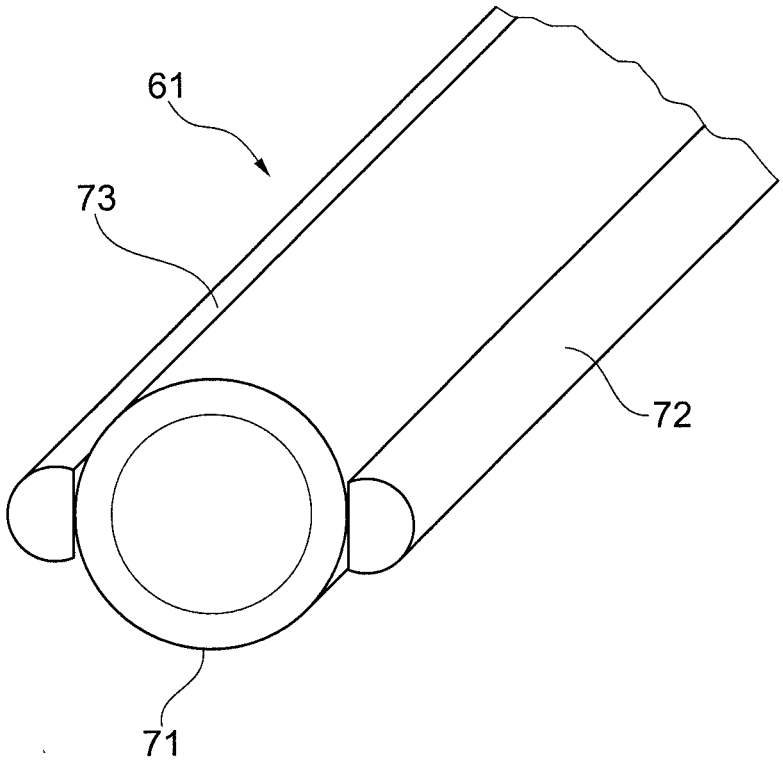
FIG. 13 schematically shows a perspective view of a part, illustrated in a cutaway manner, of a connection element of a transmission installation of the device.

FIG. 13 in a heavily schematic and perspective manner illustrates a forward end portion of a connection element which is configured as the synchronizer bar 61. A basic body 71 of the synchronizer bar 61 is configured so as to be cylindrical on the outside. The basic body 71 is preferably composed of a hollow section of a plastics material. Two convexly shaped protrusions 72, 73 are present on the outside of the basic body 71, which are diametrically opposed and which in the manner of a bulge extend along and parallel with the longitudinal axis of the basic body 71 across the entire length thereof. The protrusions 72 and 73 are plug-fittable into receptacle contours which are configured so as to be correspondingly matching on a connection portion 74 (cf. FIG. 2) on one side of the flap 43 so as to be preferably form-fitting with the flap 43, thus connecting the synchronizer bar 61 to the flap 43 in a rotationally fixed manner.

By way of a rotating movement of the flap 43 about the rotation axis D, for example, in the case of unlocking as has been described above, by way of the plug-fitted synchronizer bar 61 of which the longitudinal axis coincides with the rotation axis D, a torque is transmitted in a synchronized manner from the flap 43 of the device 58 to the synchronizer bar 61 and onward to a function unit which is present at the other end of the synchronizer bar 61 and optionally to a locking member or a flap, respectively, of a twin device 62 (cf. FIGS. 1 and 2).

LIST OF REFERENCE SIGNS

1 Ejector unit
2 Base plate
3 Force accumulator
4 Coupling installation
5 Ejector
6 Activator
7 Locking member
8 Front-gap adjustment assembly
9 Cover component
10 Coil spring
11 Coil spring
12 End
13 Fixed mounting

14 Mounting part
15 Set part
16 Operating portion
17 End
18 Motion element
19 Guide contour
20 Linear guide
21 Contact portion
22 Set screw
23 Entrainment element
24 Latch component
24*a* Guide pin
25 Guide track
26 Stop element
27 Guide track
28 Wall portion
29 Stop portion
30 Tension lever
31 Mounting pin
32 Retaining member
33 Spring element
34 Guide lever
35 Connection element
36-39 Mounting pin
40 Lever attachment
41 Locking element
42 Stop element
43 Flap
44 Contact portion
45 Housing
46 Operating portion
47 Wall portion
48 Wall
49 Leaf spring
50 Item of furniture
51 Basic furniture structure
52 Guide means
53 Drawer
54 Drawer base
55 Drawer front
56 Side wall
57 Rear drawer wall
58 Device
59 Basic structure side wall
60 Leg spring
61 Synchronizer bar
62 Device
63 Linear guide
64 Counter portion
65 Narrow side
66 Portion
67 Appendage
68 Drive portion
69 Crest
70 Web step
71 Basic body
72, 73 Protrusion
74 Connection portion

The invention claimed is:

1. An opening device attachable to a movable furniture part; the opening device being adapted to assist movement of the movable furniture part in an opening direction and in a closing direction which is counter to the opening direction, the opening device comprising:

a force accumulator configured to push the movable furniture part in the opening direction during an opening movement, the force accumulator having a tensioned position at which the force accumulator is charged for the opening movement of the movable furniture part;

a locking assembly having a displaceable locking member for locking the tensioned position of the force accumulator, wherein the locking member in the tensioned position of the force accumulator assumes a locking position which is unlockable, and wherein the locking member is movable from the locking position in a releasing direction during an unlocking procedure, the locking assembly comprising a movable drive portion, the movable drive portion being mutually adapted with the locking member such that the locking member, upon movement from the locking position under influence of the movable drive portion, is movable onward in the releasing direction;

a transmission installation adapted to transmit a movement of the locking member to a functional unit which is spaced apart from the locking member, the transmission installation comprising a synchronizer bar, the synchronizer bar comprising:

a basic body;

an outwardly projecting engagement portion molded on the basic body in a region of an external contour thereof, the engagement portion configured to engage with a receptacle portion on the locking member; and first and second convexly-shaped protrusions provided on an outside of the basic body of the synchronizer bar, the first and second convexly-shaped protrusions being diametrically opposed and defining first and second respective bulges extending along and substantially parallel with a longitudinal axis of the basic body across substantially an entire length of the basic body;

wherein in an attached state of the synchronizer bar during movement of the locking member in the releasing direction during the unlocking procedure, a transmission of movement from the locking member to the synchronizer bar is performed by the engagement portion.

2. The device according to claim 1, wherein the tensioned position of the force accumulator is unlockable by way of a linear repositioning movement of an actuator element of the device, which interacts with the locking member in an actuation direction of the actuator element;

wherein the linear repositioning movement of the actuator element in the releasing direction in relation to a fitted state of the opening device is configured to be performed by way of a movement of the movable furniture part from a predefined closing state of a furniture part on a basic furniture structure in the closing direction, wherein the coupling in terms of motion of the locking member to the functional unit is configured to be performed during the movement of the furniture part in the closing direction.

3. The device according to claim 1, wherein the drive portion in the locking position of the locking member is contiguous to the locking member.

4. The device according to claim 1, wherein the drive portion is configured on a movable lever which is coupled to the force accumulator.

5. The device according to claim 1, wherein the locking member is pivotably mounted, wherein the releasing movement comprises a pivoting movement of the locking member.

6. The device according to claim 1, wherein in the attached state the longitudinal axis of the synchronizer bar coincides with a pivot axis of the locking member.

7. An item of furniture having a basic furniture structure and a movable furniture part which by way of guide means in relation to the basic furniture structure is movable in an opening direction of the furniture part and in a closing direction which is counter to the opening direction, wherein an opening device according to claim 1 is provided.

8. The item of furniture according to claim 7, further comprising a functional unit which is spaced apart from the opening device, wherein a first end portion of the synchronizer bar is connected to the locking member of the opening device, and a second end portion of the synchronizer bar is connected to an element of the functional unit.

9. An opening device for moving a movable furniture part in an opening direction in relation to a basic furniture structure of an item of furniture, wherein the opening device comprises:

a force accumulator, the movable furniture part is capable of being put in the opening direction under action of the force accumulator, wherein in a tensioned position of the force accumulator, the force accumulator is charged for an opening movement of the movable furniture part;

a locking assembly having a displaceable locking member for locking the tensioned position of the force accumulator, wherein the locking member in the tensioned position assumes a locking position which is unlockable, wherein the locking member in the case of an unlocking procedure is movable from the locking position in a releasing direction; and a transmission installation by way of which a movement of the locking member is transmitted to a functional unit which is spaced apart from the locking member, the transmission installation comprising an elongate synchronizer bar or coupling motion of the locking member to the functional unit, a first end portion of the synchronizer bar is coupled to the locking member of the device, and a second end portion of the synchronizer bar is coupled to an element of the functional unit, the synchronizer bar having an outwardly projecting engagement portion molded thereon, the engagement portion configured to interact with a receptacle portion on the locking member, wherein in an attached state of the synchronizer bar during a releasing movement of the locking member in the releasing direction, a transmission of movement from the locking member to the synchronizer bar is performed by way of the engagement portion, the synchronizer bar further comprising first and second convexly-shaped protrusions provided on an outside of a basic body of the synchronizer bar, the first and second protrusions being diametrically opposed and defining first and second respective bulges extending along and substantially parallel with a longitudinal axis of the basic body across substantially an entire length thereof.

* * * * *